US007373744B1

(12) United States Patent
Wagner

(10) Patent No.: US 7,373,744 B1
(45) Date of Patent: May 20, 2008

(54) LAMPSHADE

(76) Inventor: Jon K. Wagner, 90 Horseshoe Blvd., Annville, PA (US) 17003

( * ) Notice: Subject to any disclaimer, the term of this patent is extended or adjusted under 35 U.S.C. 154(b) by 340 days.

(21) Appl. No.: 10/868,120

(22) Filed: Jun. 15, 2004

(51) Int. Cl.
*G09F 13/00* (2006.01)

(52) U.S. Cl. ..... 40/554

(58) Field of Classification Search ..... 40/554, 40/555, 579, 580, 574, 603, 441, 431, 432, 40/502

See application file for complete search history.

(56) References Cited

U.S. PATENT DOCUMENTS

| | | | | |
|---|---|---|---|---|
| 1,310,347 | A | 6/1919 | Karfiol | |
| 1,466,033 | A | 8/1923 | Shepherd et al. | |
| 1,972,687 | A * | 9/1934 | McCoy | 40/441 |
| 2,133,188 | A * | 10/1938 | Salvatore | 219/220 |
| 2,287,122 | A | 6/1942 | Norris | 204/11 |
| 3,456,106 | A * | 7/1969 | Gluschkin | 362/98 |
| 3,610,143 | A | 10/1971 | Greenwood et al. | 101/128.2 |
| 4,117,532 | A | 9/1978 | Arbib | 362/358 |
| 4,934,039 | A | 6/1990 | Coburn, Jr. et al. | 29/527.2 |
| 5,309,333 | A * | 5/1994 | Kandampully | 362/121 |
| 5,328,587 | A | 7/1994 | Fenske | 205/73 |
| 6,712,522 | B2 | 3/2004 | Watanabe et al. | 385/60 |
| 6,729,747 | B1 | 5/2004 | Wirayani | 362/356 |

FOREIGN PATENT DOCUMENTS

JP 2004139811 A * 5/2004

* cited by examiner

*Primary Examiner*—Cassandra Davis
(74) *Attorney, Agent, or Firm*—Hooker & Habib, P.C.

(57) ABSTRACT

A lampshade has a body with a number of spaced-apart apertures extending through the thickness of the body. The apertures are arranged in a pattern defining an image on the lampshade. Each aperture is sufficiently small in cross section to form an illuminated image pixel from normal viewing distances when the lampshade is illuminated by a lamp.

20 Claims, 6 Drawing Sheets

LAMPSHADE

FIELD OF THE INVENTION

The invention relates to lampshades.

DESCRIPTION OF THE PRIOR ART

Lampshades serve as important ornamental details in a room or home interior design. Manufacturers offer lampshades in a wide variety of materials and designs. Nevertheless, there is always a need for an improved lampshade that has unique visual appeal and can be produced in a wide variety of ornamental designs.

SUMMARY OF THE INVENTION

The invention is an improved lampshade that has unique visual appeal and can be produced in a wide variety of ornamental designs.

A lampshade in accordance with the present invention includes a body and a number of spaced-apart apertures extending through the thickness of the body. The apertures are arranged to define an image on the lampshade. Each aperture is sufficiently small in cross section to form an illuminated image pixel from normal viewing distances when the lampshade is illuminated by the lamp.

The image is formed on the lampshade in a manner analogous to halftone printing of grayscale images in which the apertures represent solid white pixels and the lampshade body represents a black substrate. A wide variety of images can be defined by changing the arrangement of apertures, the size of apertures, or both. Images on the lampshade can be perceived as having a tonal range extending from relatively dark to relatively light.

Images that can be used in embodiments of the invention include converted photographs or computer graphics, text images, silhouettes, business and sports logos, and abstract images. Essentially any image that can be displayed by halftone printing can be displayed on the lampshade. Lampshades can be designed for particular markets or customers, and custom made-to-order lampshades can be provided.

In a preferred embodiment the lampshade is formed entirely from nickel. Nickel has good mechanical strength and corrosion resistance, and has a pleasing appearance even if left unfinished. The outer surface of the lampshade can be painted if desired.

The lampshade can be formed as a seamless cylinder employing plating methods used in making rotary printing stencils. A seamless cylinder enables a continuous, non-interrupted image area to extend around the circumference of the lampshade.

In other embodiments the lampshade can be formed as a substantially flat panel for use with fluorescent lamps, lamp boxes, and the like.

In yet other embodiments a diffuser can be placed between the light source and the lampshade. The diffuser can be made with sufficient contrast against the lampshade such that the image can be perceived under ambient lighting even when the lamp is off. Alternatively, the diffuser can have sufficiently low contrast such that the image is essentially "invisible" until the lamp is turned on.

Other objects and features of the invention will become apparent as the description proceeds, especially when taken in conjunction with the accompanying 6 drawing sheets illustrating an embodiment of the invention.

DESCRIPTION OF THE PREFERRED EMBODIMENT

Figure 1:
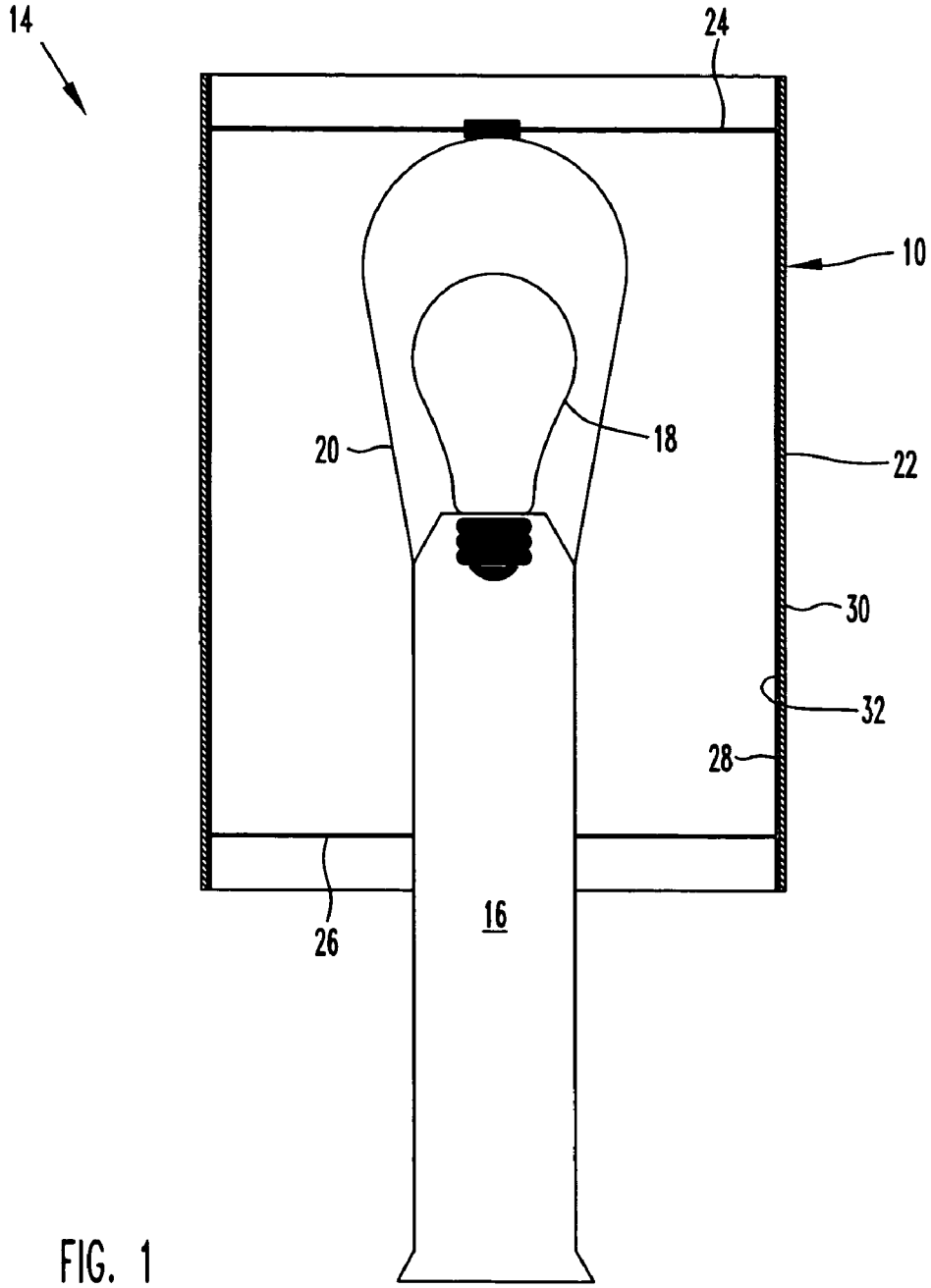
FIG. 1 is a vertical sectional view of a lampshade assembly that includes a lampshade in accordance with the present invention, the lampshade assembly mounted on a lamp.

FIG. 1 illustrates a lampshade assembly 10 that includes a lampshade in accordance with the present invention. Lampshade assembly 10 is mounted on a conventional electric lamp 12 to form lamp assembly 14. Lamp 12 includes a base 16 that carries an incandescent light bulb 18. A harp 20 attached to the base 16 supports the lampshade assembly 10 on the lamp.

Lampshade assembly 10 includes a cylindrical lampshade 22. A conventional mounting bracket 24 at the upper end of the lampshade 22 is carried by the harp 20 to position the lampshade 22 with respect to the light bulb. Other conventional types of mounting structure for supporting a lampshade on a lamp can be readily adapted for use in other embodiments.

A stiffening ring 26 at the lower end of the lampshade 22 adds additional stiffness to the lampshade assembly, and can be omitted if the lampshade 22 has sufficient rigidity. A diffuser 28 formed from translucent plastic lines the inside of the lampshade 22.

Lampshade 22 has outer and inner circumferential surfaces 30, 32 separated by the thickness of the lampshade. Lampshade 22 is preferably made of metal but could be manufactured from plastic or other suitable materials. The illustrated embodiment is made of electrodeposited nickel and is a seamless cylinder 8 inches in diameter, 9 inches long, and 0.006 inches thick.

Figure 2:
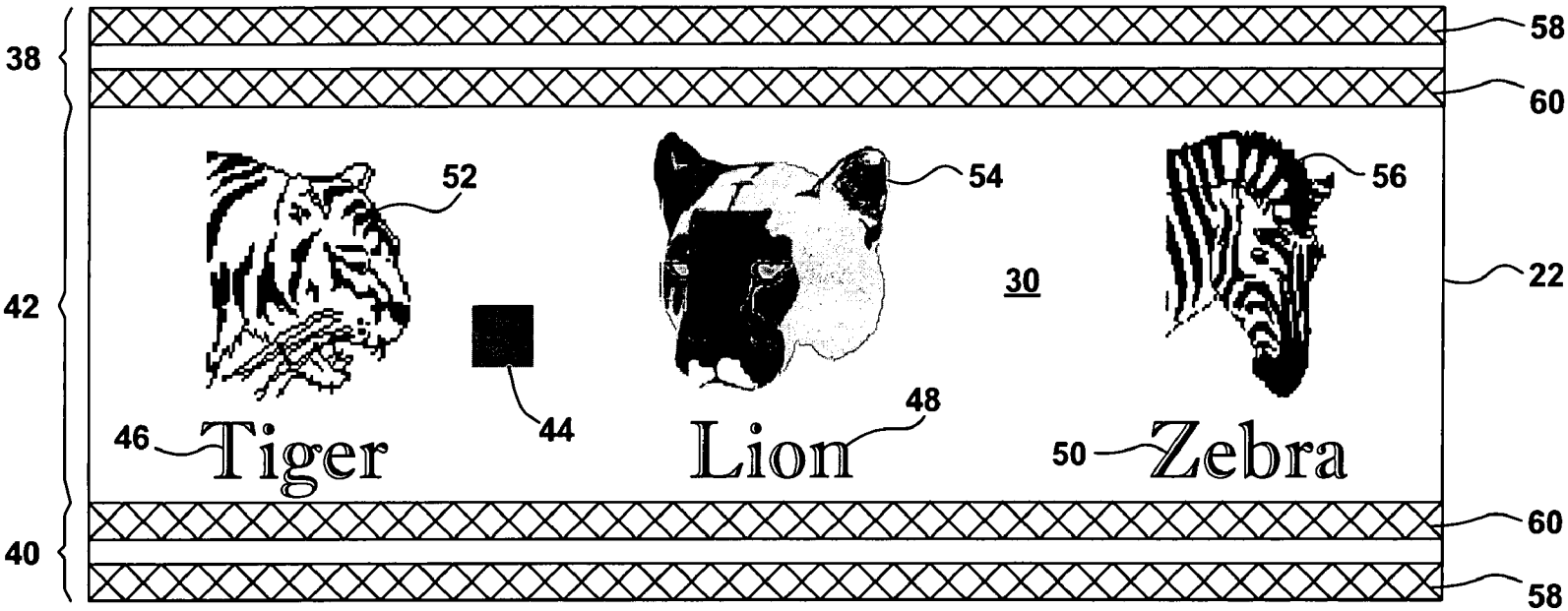
FIG. 2 is a developed view of the lampshade shown in FIG. 1 illustrating images on the outer surface of the lampshade.

FIG. 2 is a developed view of the lampshade 22. As illustrated in the figure, lampshade outer surface includes upper and lower edge border areas 38, 40 extending along opposite axial ends of the lampshade. A circumferential image region or image area 42 extends between the border areas 38, 40.

Image area 42 includes a number of images 44-56 that add unique ornamental interest to the lampshade. Image 44 is a uniform background image that covers the entire image area 42; for clarity only a portion of image 44 is shown in FIG. 2. Images 46-56 are foreground images that appear to be superimposed over background image 44. Images 46, 48, and 50 are text images that display a string of text characters. Images 52, 54, and 56 are non-textual images.

It is understood that the illustrated text and images are for illustration only and are not intended to limit the scope of the invention. Other embodiments may have different images, different numbers, sizes, and arrangement of images, and, if text images are used, different text fonts and font sizes. Abstract images can also be used that do not represent a physical object or thing.

Each border area 40, 42 also include open-mesh or filigree portions 58, 60 that add additional ornamental interest to the lampshade.

Figure 3:
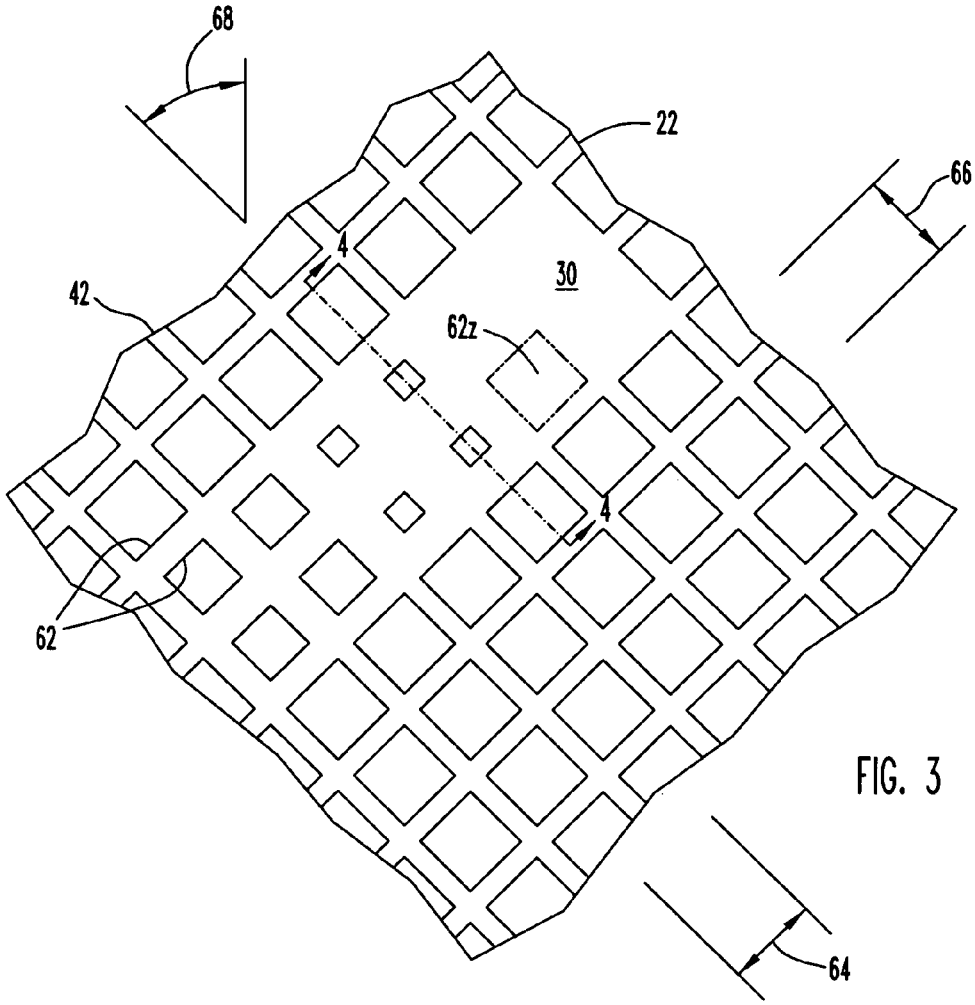
FIG. 3 is a closer view of the outer surface shown in FIG. 2.
Figure 4:
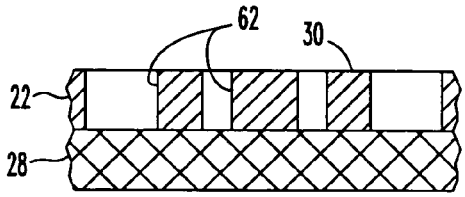
FIG. 4 is a sectional view taken along line 4-4 of FIG. 3, also showing the diffuser that is part of the lampshade assembly.

Image area 42 includes a number of spaced-apart apertures 62 that are used to define images 44-56. See FIGS. 3 and 4, which illustrate a portion of image area 42. The apertures 62 extend through the thickness of the lampshade 22 and enable light from the bulb 18 to pass through the lampshade. The cross-section area of each aperture 62 is sized such that the light transmitted through the aperture is perceived from normal viewing distances as essentially a point of light located on outer lampshade surface 30.

Groups of apertures 62 are arranged in patterns that define respective images 44-56. Each point of light from an aperture 62 defines a single picture element or pixel of the associated image. The number of apertures, or pixels, forming an image can vary with image size, shape, and appearance.

The use of apertures 62 to define image pixels on outer surface 30 is analogous to conventional halftone printing of gray-scale images. A gray-scale image includes only the colors black, white, and shades of gray. One method of halftone printing gray-scale images involves depositing a pattern of white halftone dots (also known as picture elements or pixels), on a black substrate. Areas of the substrate not covered by dots appear 100% black, and areas entirely covered by dots appear 100% white. Areas only partially covered by white dots appear gray, a mixture of black and white.

Shades of gray are controlled by varying dot size, dot spacing, or both. The more white per unit area the lighter the shade; the less white per unit area the darker the shade. By controlling dot coverage per unit area of substrate, an image can appear to include a number of different gray shades even if printed in only black and white.

Outer lampshade surface 30 represents the substrate for image area 42. Areas of image area 42 that have no apertures 62 block all incident light from the bulb 18. Such areas represent 100% black. Apertures 62 transmit essentially all incident light that strike them from bulb 18, and represent 100% white pixels. Areas of image area 42 that include spaced-apart apertures 62 only partially block incident light and represent levels of gray. Varying the size, spacing, or both of a set of apertures 62 associated with a given image causes the image to appear to the eye as containing different shades of gray (although the image is actually formed by white pixels 62 on a black substrate 30).

Apertures 62 of the illustrated lampshade 22 are arranged in a rectilinear grid pattern of rows and columns having fixed, equal column and row line spacing 64, 66. The cross-section areas of the apertures 62 vary to define different shades of gray.

Each aperture 62 is square-shaped to maximize the maximum aperture area consistent with the mechanical strength of nickel. Other aperture shapes can be used, including circular, hexagonal, or non-uniformly shaped apertures. Maximally-size apertures 62 form the lightest gray shade, about 80% white in the illustrated embodiment.

Aperture row and column spacing is preferably between 5 lines per inch and 150 lines per inch; apertures 62 are spaced at 32 lines per inch and a helix angle 68 of about 45 degrees with respect to the cylinder axis.

Background image 44 is formed by uniform-sized pixels (apertures) that define a uniform gray shade of about 30% white. This ensures that sufficient light is transmitted through the lampshade 22 to provide some room illumination. Other lamps equipped with lampshades in accordance with the present invention may be intended for image display only and not for lighting.

Background images 46-56 are each formed by varying tone density (aperture) within the image to collectively define a grayscale image. Omitting an aperture defines a zero-width, 0% white pixel, that is, the substrate defines a solid black pixel at that aperture location. An example of a black pixel 62*z* is shown in phantom in FIG. 3.

Images may have a tonal range extending from black to the lightest shade of gray that can be formed by maximum-sized apertures. Images having a relatively wide dynamic tonal range provide very pleasing visual effects, but uniformly gray or more limited tonal range images can also be used.

Figure 5:
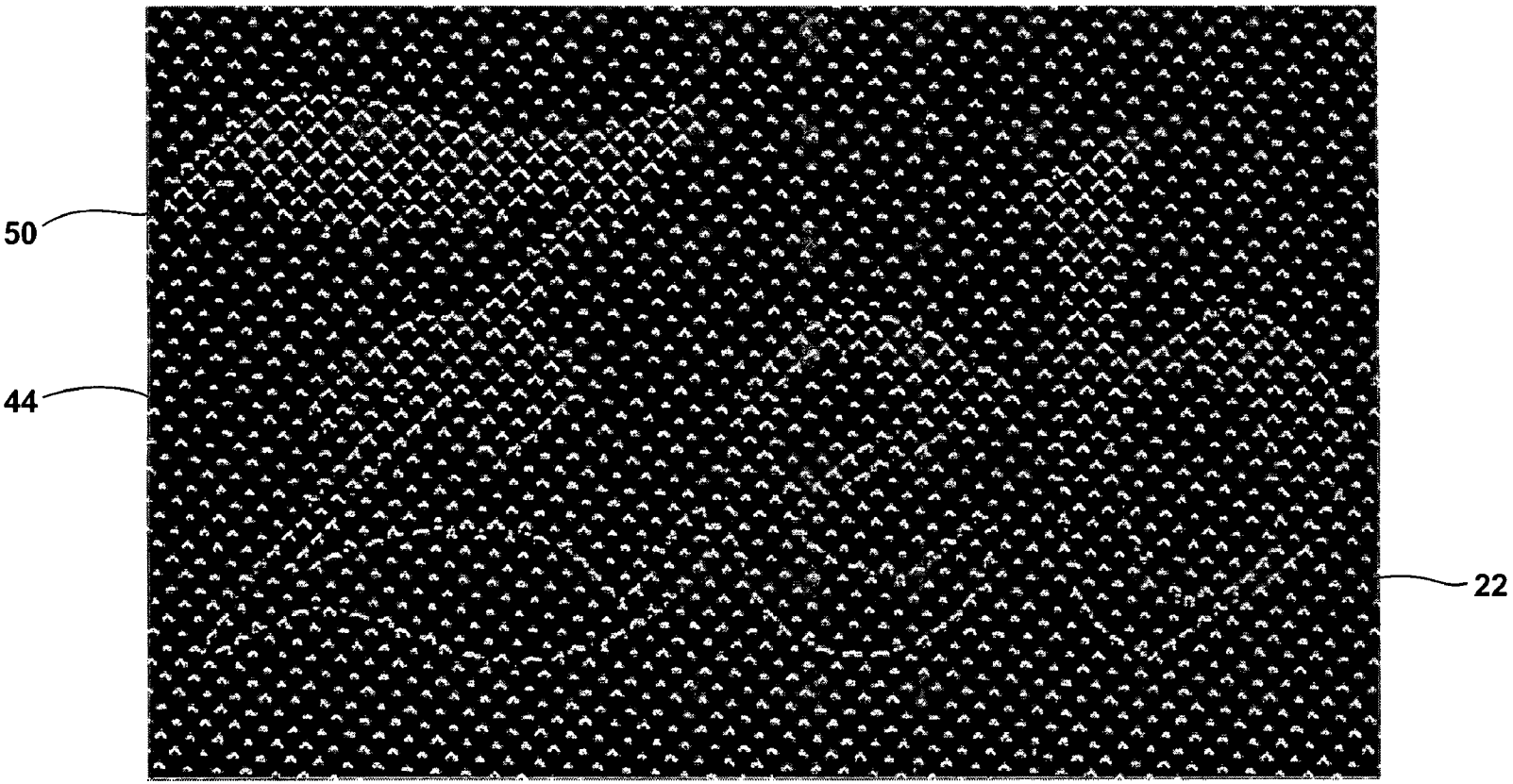
FIG. 5 is a view similar to FIG. 3 but at a larger scale.

FIG. 5 is a closer view of the area around the letters "Zeb" of image 50 against the uniform gray background 44. Each letter is formed as a subimage made by varying the tone density of each letter. In the illustrated embodiment the pixels forming the top portion of each letter has a higher tone density than the bottom portion of each letter. As a result the letters have a vertical tonal gradient that extends from about 80% white at the top of the letters to nearly black at the bottom.

When lamp 16 is in use, light from bulb 18 passes through the apertures 62 in image area 42 to form illuminated pixels on the outer surface of the lampshade. As described above, the size of the apertures 62 vary to define pixels ranging from 0% white to a maximum 80% white. An image can have a uniform gray shade, as with background image 44, or can include a tonal range as with images 46-56. For example, image 56 is an image of a zebra; darker shades of gray or black define the darker stripes and lighter shades of gray define the lighter stripes.

Diffuser 28 faces the entire image area 42 and diffuses the light from bulb 18 to more evenly illuminate the image area. Diffuser 28 is white, which provides visual contrast with the outer surface of the lampshade even when the lamp is off. The contrast is sufficiently great to enable the images defined by apertures 62 to be perceived under normal ambient lighting when the lamp is off. If desired, diffusers that do not contrast with the lampshade 22 can be used so that images are "invisible" until the lamp is turned on. Diffusers tinted a different color or multi-colored diffusers can also be used.

Lampshade 22 is manufactured using essentially the same steps used in manufacturing metal rotary screens for rotary printing machines. The screen includes apertures that pass ink to transfer images onto substrates. The apertures in lampshade 22 are, in effect, used to pass light rather than ink.

Figure 6:
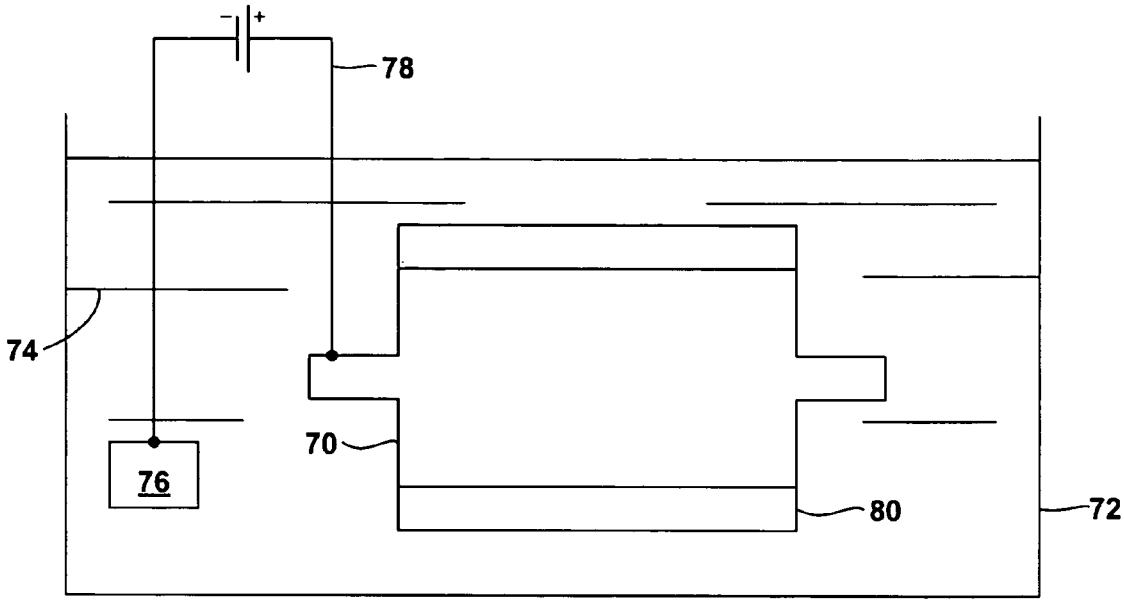
FIG. 6 is a schematic view of a mandrel in an electrolyte tank after forming a nickel tube on the mandrel in preparation of forming the lampshade.

As shown in FIG. 6, a steel mandrel 70 plated with nickel is placed in a tank 72 filled with a nickel sulfamate plating solution 74. The mandrel has a cylindrical outer surface to form a cylindrical lampshade. The diameter of the outer surface is slightly less than the desired inner diameter of the lampshade. Differently shaped mandrels, including those having frustoconical outer surfaces, can be used to form differently-shaped lampshades.

A pure nickel anode 76 is placed in the tank. Anode 76 typically is formed from nickel slugs. Electric circuit 78 electrically connects the mandrel 70 and nickel anode 76. Energizing the circuit forms an electrodeposited solid nickel tube 80 surrounding mandrel 70.

Mandrel 70 carrying tube 80 is removed from tank 72. An outer coating of a conventional photoresist 82 is deposited on the outer surface of tube 80. Photoresist 82 has a thickness less than the desired thickness of the lampshade 22.

Figure 7:
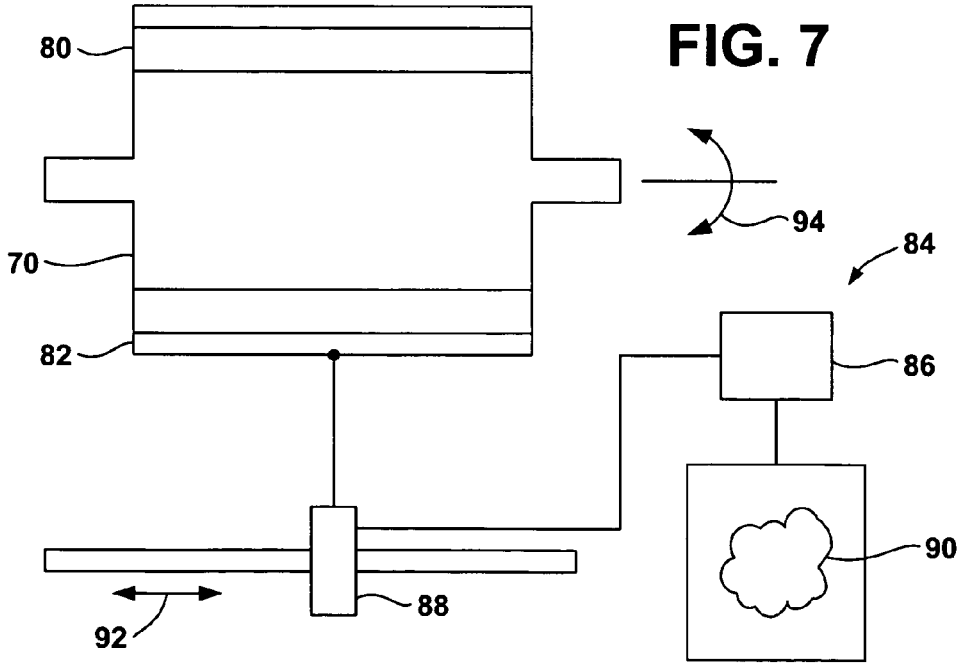
FIG. 7 is a schematic view of a laser engraving machine engraving a pixel pattern corresponding to the lampshade images on a photoresist coating applied to the nickel tube on the mandrel.

A laser engraving machine 84 engraves the desired aperture matrix or pixel pattern on photoresist 82. See FIG. 7. Engraving machine 84 may be a LEX4002 or LEX4003 laser engraving machine manufactured by Stork N.V., Naardan, Netherlands. A control system 86 controls a laser 88 to radiate locations on the photoresist corresponding to the desired aperture location, aperture size, and filigree openings of the lampshade 22. The laser cures the radiated portions of the photoresist while the remainder of the photoresist remains uncured.

Control system 86 includes bitmap data 90 representing the images and filigree to be formed on lampshade 22. The images can be obtained from hand drawings, digital or analog photographs, clipart, graphics or CAD software, and the like. The images are converted to bitmaps based on grid spacing and grid orientation. Techniques and software to convert images to gray-scale bitmaps are known and so will not be in further detail. The bitmap data is stored in the control system 86, which automatically controls relative laser and matrix location along linear axis 92 and circumferential axis 94 while engraving the photoresist.

Figure 8:
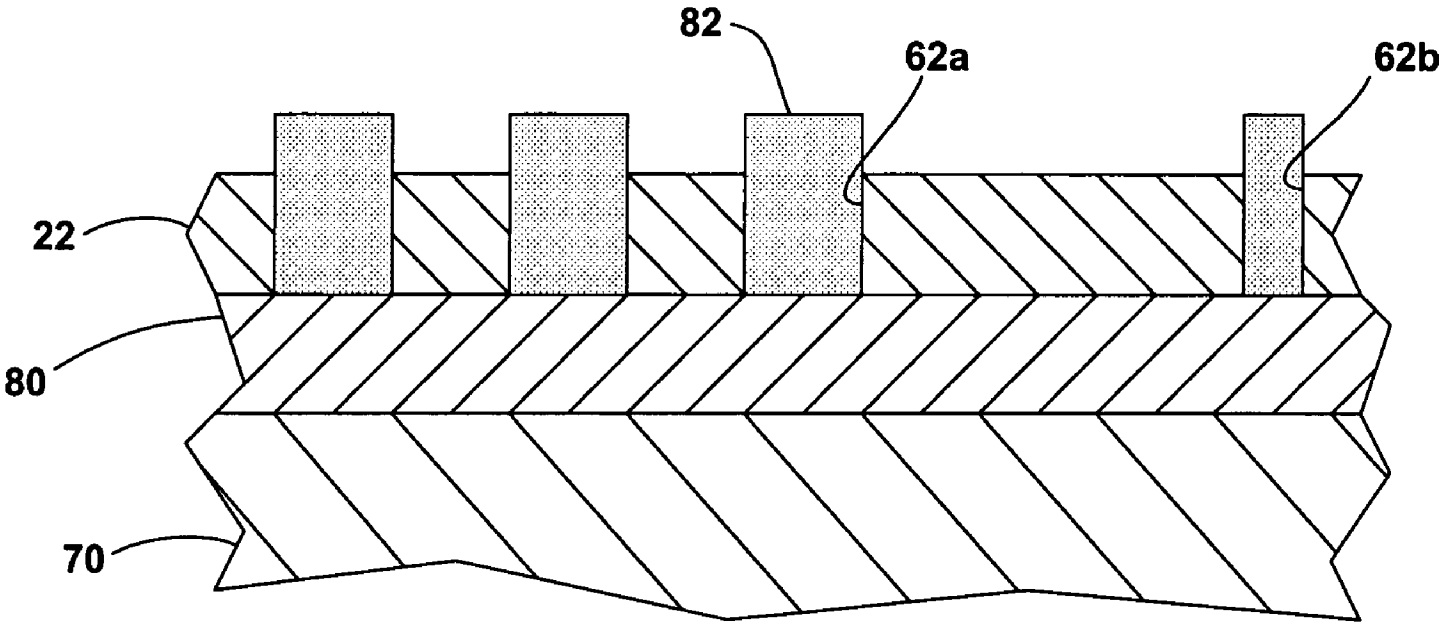
FIG. 8 is a partial sectional view of the lampshade shown in FIG. 1 formed on the mandrel prior to separation from the mandrel and nickel tube.

Uncured photoresist is washed off tube 80 after engraving. The mandrel assembly is then returned to tank 72 and nickel is electrodeposited on tube 80 to form lampshade 22. See FIG. 8, which illustrates the lampshade partially formed on the mandrel. Nickel is not deposited on portions of tube 80 covered by photoresist, thereby forming the apertures 62 and filigree openings in the lampshade. For example, in FIG. 8 aperture 62*a* is wider than aperture 62*b*, and a zero-width aperture (that is, an omitted aperture) is between apertures 62*a* and 62*b*. Lampshade 22 is preferably formed with a thickness between 0.003 inches and 0.010 inches, but could be thicker or thinner.

Tube 80 and completed lampshade 22 are removed from mandrel 70 and then separated. Tube 80 can be reused on mandrel 70 a number of times if desired. The cured photoresist is then removed from the openings in the lampshade 22.

Multiple numbers of axially-spaced lampshades can be simultaneously formed on a single mandrel, with adjacent lampshades separated by a circumferential band of cured photoresist. It is not necessary that the lampshade designs be identical.

To complete the lampshade assembly 10, diffuser 28, mounting bracket 24, and stiffening ring 26 are installed. Lampshade 22 is left unfinished as the nickel has a pleasing appearance, but outer surface 30 can be painted if desired. For example, image areas could be painted in colors associated with respective images.

Lampshades in accordance with the present invention can also be formed from other materials or by using other manufacturing methods. For example, a cylindrical, blow-molded plastic tube could be provided in which apertures defining the pixels are made using small diameter punches.

It is also contemplated that lampshades in accordance with the present invention may be formed as generally flat or planar panels. For example, lampshade 22 can be slit and unrolled to form a flat metal panel for use with lamps having fluorescent lights. The panel would be mounted to the fluorescent lamp in the same manner as conventional panels.

While I have illustrated and described a preferred embodiment of my invention, it is understood that this is capable of modification, and I therefore do not wish to be limited to the precise details set forth, but desire to avail myself of such changes and alterations as fall within the purview of the following claims.

The invention claimed is:

1. A lampshade for shading a light source, the lampshade comprising:

a body having opposed first and second surfaces separated by the thickness of the body; and a plurality of spaced-apart apertures arranged in rows and columns, each aperture extending through the thickness of the body, the apertures arranged to define a grayscale image on the lampshade, each aperture sufficiently small in cross section to form an illuminated image pixel from normal viewing distances when the lampshade is illuminated by the light source.

2. The lampshade of claim 1 wherein the plurality of apertures comprises a first set of apertures and a second set of apertures; and each set of apertures comprising an aperture size and aperture spacing associated with the set, the aperture size or aperture spacing of the first set not equal to the corresponding aperture size or aperture spacing of the second set;

whereby the first set represents a first gray level and the second set represents a second, different gray level.

3. The lampshade of claim 1 wherein the row and column spacing of the first set of apertures is equal to the row and column spacing of the second set of apertures.

4. The lampshade of claim 1 wherein the row and column spacing of the apertures are between five apertures per inch and 150 apertures per inch.

5. The lampshade of claim 4 wherein the aperture spacing is not less than 32 apertures per inch.

6. The lampshade of claim 1 wherein at least one of the plurality of apertures defines a 0% white pixel.

7. The lamp assembly of claim 1 wherein an aperture of said plurality of apertures comprises one of: a square cross section, a hexagonal cross section, and a circular cross section.

8. The lampshade of claim 1 wherein the lampshade is formed from metal.

9. The lampshade of claim 8 wherein the lampshade is formed from electrodeposited nickel.

10. The lampshade of claim 1 wherein the lampshade is a seamless cylindrical body.

11. The lampshade of claim 1 wherein the lampshade thickness is between 0.003 inches and 0.010 inches.

12. The lampshade of claim 1 wherein the lampshade has a circumference and the apertures are spaced around the circumference of the lampshade.

13. A lamp assembly for displaying a predefined image on a lampshade of the assembly, the assembly comprising:

a lamp and a lampshade assembly;

the lamp comprising a light source energizable to emit light;

the lampshade assembly comprising a lampshade and structure mounting the lampshade to the lamp;

the lampshade having a thickness and comprising a plurality of apertures arranged in rows and columns, each aperture extending through the thickness of the lampshade and sized to define an illuminated pixel on an outer surface of the lampshade when the light source is energized, the apertures varying in either cross-sectional area or in row and column spacing so that the pixels define different levels of gray, the pixels arranged to define a visually perceptible grayscale display of the image.

14. The lamp assembly of claim 13 wherein the gray level of the pixels varies from between 0% white and 80% white.

15. The lamp assembly of claim 13 wherein the row and column spacings of the apertures vary to vary the gray level of the pixels.

16. The lamp assembly of claim 13 wherein the cross-sectional areas of the apertures vary to vary the gray level of the pixels.

17. The lamp assembly of claim 16 wherein the apertures define pixels having gray levels between 0% white and 80% white.

18. The lamp assembly of claim 13 wherein each aperture is spaced apart between adjacent apertures at between five apertures per inch and 150 apertures per inch.

19. The lamp assembly of claim 13 comprising a diffuser between the light source and the lampshade.

20. The lamp assembly of claim 13 wherein the aperture row and column spacings are between five apertures per inch and 150 apertures per inch and the gray scale of the pixels vary between 0% white and 80% white.

* * * * *